US011795582B2

(12) United States Patent
Dürnberger et al.

(10) Patent No.: US 11,795,582 B2
(45) Date of Patent: Oct. 24, 2023

(54) SPINNING DEVICE AND METHOD FOR SPINNING UP A SPINNING DEVICE

(71) Applicant: Lenzing AG, Lenzing (AT)

(72) Inventors: Franz Alfred Dürnberger, Lenzing (AT); Karl Ladner, Linz (AT); Martin Lauber, Linz (AT); Daniel Reischl, Linz (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 336 days.

(21) Appl. No.: 16/754,933

(22) PCT Filed: Oct. 8, 2018

(86) PCT No.: PCT/EP2018/077356
§ 371 (c)(1),
(2) Date: Apr. 9, 2020

(87) PCT Pub. No.: WO2019/072776
PCT Pub. Date: Apr. 18, 2019

(65) Prior Publication Data

US 2020/0263324 A1 Aug. 20, 2020

(30) Foreign Application Priority Data

Oct. 12, 2017 (EP) ..... 17020468

(51) Int. Cl.
*D01D 5/02* (2006.01)
*D01D 10/04* (2006.01)
(Continued)

(52) U.S. Cl.
CPC ..... *D01D 5/02* (2013.01); *B65H 51/02* (2013.01); *B65H 54/00* (2013.01); *D01D 4/022* (2013.01);
(Continued)

(58) Field of Classification Search
CPC ..... D01D 5/02; D01D 4/022; D01D 5/06; D01D 5/18; D01D 10/00; D01D 10/04;
(Continued)

(56) References Cited

U.S. PATENT DOCUMENTS 2,228,155 A 1/1941 Serinis
3,675,865 A * 7/1972 Eschenbach ..... B65H 54/80 57/66
(Continued)

FOREIGN PATENT DOCUMENTS

CN 1124509 A 6/1996
CN 103147182 A 6/2013
(Continued)

OTHER PUBLICATIONS

Definition of Turntable, Merriam-Webster Dictionary, https://www.merriam-webster.com/dictionary/turntable (Year: 2022).*
International Search Report issued in International Patent Application No. PCT/EP2018/077356 dated Nov. 22, 2018. 2 pages.
(Continued)

*Primary Examiner* — Jacob T Minskey
*Assistant Examiner* — Caroline Beha
(74) *Attorney, Agent, or Firm* — VENABLE LLP

(57) ABSTRACT

What is shown is a spinning device (1) and a method for spinning up a spinning device (1) for the continuous extrusion of molded bodies (3) from a spinning solution (6), as well as a spin-up device (11) for the execution of the method, in which method the molded bodies (3) are extruded from the spinning solution (6) through spinnerets (7) of the spinning device (1) in the form of a loose spinning curtain (2), the molded bodies (3) of the loose spinning curtain (2) are, after the extrusion, combined into a molded body bundle (4), and the molded body bundle (4) is, in a further step, fed to a draw-off member (10) of the spinning device (1) in order to start a continuous extrusion of the molded bodies (3). In
(Continued)

order to make the method for spinning up the spinning device (1) simpler and more reproducible, it is proposed that the molded bodies (3) be combined into the molded body bundle (4) by twisting the spinning curtain (2) around a torsion axis (20).

11 Claims, 5 Drawing Sheets

(51) Int. Cl.

| | |
|---|---|
| ***D01D 4/02*** | (2006.01) |
| ***D01D 5/18*** | (2006.01) |
| ***D01D 13/02*** | (2006.01) |
| ***B65H 54/00*** | (2006.01) |
| ***B65H 51/02*** | (2006.01) |
| ***D01D 5/06*** | (2006.01) |
| ***D01D 10/00*** | (2006.01) |

(52) U.S. Cl.
CPC ..... *D01D 5/06* (2013.01); *D01D 5/18* (2013.01); *D01D 10/00* (2013.01); *D01D 10/04* (2013.01); *D01D 13/02* (2013.01); *B65H 2701/3132* (2013.01)

(58) Field of Classification Search
CPC ..... D01D 13/02; B65H 51/02; B65H 54/00; B65H 2701/3132; B01D 69/085; B01D 69/00
See application file for complete search history.

(56) References Cited

U.S. PATENT DOCUMENTS

| | | | | | |
|---|---|---|---|---|---|
| 4,702,876 | A | | 10/1987 | Ebregt et al. | |
| 5,913,994 | A | * | 6/1999 | Avril | B29C 53/564 156/169 |
| 5,935,289 | A | * | 8/1999 | Arterburn | C03B 37/02 264/177.17 |
| 5,939,000 | A | * | 8/1999 | White | D01D 4/02 264/211.14 |
| 5,951,932 | A | | 9/1999 | White et al. | |
| 2003/0035951 | A1 | * | 2/2003 | Magill | D01F 1/10 428/375 |
| 2008/0048358 | A1 | * | 2/2008 | Zikeli | D01D 5/06 425/200 |
| 2010/0148404 | A1 | * | 6/2010 | Smida | D02G 3/36 425/66 |

FOREIGN PATENT DOCUMENTS

| | | | | | |
|---|---|---|---|---|---|
| EP | 0574870 | A1 | | 12/1993 | |
| EP | 0746642 | B1 | | 4/1999 | |
| GB | 2301309 | A | | 11/1995 | |
| JP | 2009084757 | A | | 4/2009 | |
| JP | 5288091 | B2 | * | 9/2013 | |
| WO | 9428218 | A1 | | 12/1994 | |
| WO | WO-2015198698 | A1 | * | 12/2015 | B65H 65/00 |

OTHER PUBLICATIONS

Written Opinion of the International Searching Authority issued in International Patent Application No. PCT/EP2018/077356 dated Nov. 22, 2018. 5 pages.

* cited by examiner

1

1

SPINNING DEVICE AND METHOD FOR SPINNING UP A SPINNING DEVICE

The present application is a national-stage entry under 35 U.S.C. § 371 of International Patent Application No. PCT/EP2018/077356, published as WO 2019/072776 A1, filed Oct. 8, 2018, which claims priority to EP 17020468.9, filed Oct. 12, 2017, the entire disclosure of each of which is hereby incorporated by reference.

BACKGROUND OF THE INVENTION

Technical Field

The invention relates to a spinning device and a method for spinning up a spinning device for the continuous extrusion of molded bodies from a spinning solution, as well as to a spin-up device for the execution of the method, in which method the molded bodies are extruded from the spinning solution through spinnerets of the spinning device in the form of a loose spinning curtain, the molded bodies of the loose spinning curtain are, after the extrusion, combined into a molded body bundle, and the molded body bundle is, in a further step, fed to a draw-off member of the spinning device in order to start a continuous extrusion of the molded bodies.

Background of the Invention

Spinning devices of the type mentioned at the outset and the spinning methods performed therewith are known from prior art for the production of molded bodies such as fibers, filaments, sheets, etc. Particularly in the textile industry, said methods are used for the production of spun staple or continuous fibers. For the extrusion of the molded bodies, the spinning solution is, in such case, forced through a plurality of spinnerets.

Prior to the further treatment of the extruded molded bodies in subsequent method steps such as washing, pressing, drying, etc. which do not take place in the spinning device itself, the extruded molded bodies must be transported continuously out of the spinning device, for example, via a draw-off member. In order to feed the molded bodies to such a draw-off member, they must first be combined into a bundle.

Generally, it is mentioned that this first part of a spinning method is referred to as a spin-up or lace-up method or method for spinning up or lacing up a spinning device. Spinning up of a spinning device constitutes a first phase of a spinning method, which is to permit and/or initiate a continuous extrusion of molded bodies in the spinning method. Accordingly, the spin-up method comprises all method steps of a spinning method that are necessary between the end of a first continuous extrusion and a subsequent continuous extrusion, for example, after a stoppage of the spinning device or after spinning defects such as rupturing of a few molded bodies below the spinnerets have occurred.

WO 94/28218 A1 shows, for example, a spinning device of the type mentioned at the outset, wherein the spinning curtain extruded from the spinnerets is passed through a bottom-side opening of the spinning bath container. In this case, the bottom-side opening has a reducing effect on the diameter of the spinning curtain, whereby the molded bodies are combined into a molded body bundle. However, the very high immersion depths of the spinning bath containers disclosed in connection therewith make spinning up and manipulating the spinning curtain considerably more difficult. Therefore, such spinning devices suffer from a low degree of reproducibility of the spin-up method and a high susceptibility to spin-up defects that do not permit a satisfactory continuous extrusion of the molded bodies and often require renewed spinning up.

Spinning devices to facilitate the spin-up process are also known from prior art. EP 0 574 870 A1, for instance, shows a spinning device wherein the extruded molded bodies, after exiting the spinnerets in the form of a spinning curtain, are combined into a molded body bundle. This is accomplished by using a spinning funnel in the spinning bath of the spinning bath container, whose cross-section narrows in a downward direction and which has a narrowed bottom outlet opening. When the spinning curtain is passed through the spinning funnel, a molded body bundle is created when the molded bodies exit the spinning funnel, which facilitates the further handling of the molded bodies in the spinning device during spin-up. Nevertheless, such spinning funnels are disposed disadvantageously deep in the spinning bath container, which does not make handling by the operator easy. In addition, a shortcoming of such spinning devices is that high quantities of spinning bath liquid must at all times be flowing through the spinning funnel in the spinning bath container in order to ensure satisfactory functioning, which however causes turbulent currents in the spinning bath and adversely impacts the process conditions during the continuous extrusion of the molded bodies.

In order to remedy the above-mentioned disadvantages, EP 0 746 642 B 1 describes a spinning device wherein a bundling element for bundling the molded bodies is provided in the form of a deflection element in the spinning bath container. While such devices help avoid the above-mentioned turbulent currents in the spinning bath, they make the spin-up process considerably more difficult, as they require initial, manual bundling of the spinning curtain into a molded body bundle by the operator in order to provide the molded bodies in the deflection element. However, this disadvantageously requires a high physical effort from the operator. In addition, such a spin-up method is highly susceptible to spin-up defects, more particularly to incomplete bundling of the spinning curtain.

SUMMARY OF THE INVENTION

It is therefore the object of the present invention to design a spin-up method of the type mentioned at the outset that is simpler in terms of process technology and more reproducible.

The invention solves the object regarding the spin-up method in that the molded bodies are combined into the molded body bundle by twisting the spinning curtain around a torsion axis.

If the molded bodies are combined into the molded body bundle by twisting the spinning curtain around a torsion axis, the continuous extrusion of the molded bodies and bundling into a homogeneous molded body bundle can be improved significantly, which particularly benefits the reliability of the spin-up method. During twisting of the spinning curtain, the various molded bodies are twisted around a common point of contact with one another so that the compact molded body bundle is created at the point of contact. The torsion of the spinning curtain, that is, the twisting of the various molded bodies around the common point of contact, can also have a particularly advantageous effect in favor of a low defect rate while bundling the molded bodies, since almost all molded bodies can be reliably combined in the bundle. Furthermore, this can be done with a considerably lower physical effort. In addition, in the known prior art methods for spinning up spinning devices, the insufficiently fast removal of the molded bodies following their extrusion from the spinnerets can, more particularly, cause an accumulation of the molded bodies and thus bloating of the spinning curtain during spin-up. During bloating of the spinning curtain, individual molded bodies in the spinning curtain can in turn stick to one another, which has a particularly negative impact on the integrity and homogeneity of the molded body bundle. The torsion of the spinning curtain can overcome these disadvantages in that, more particularly, not only a compact molded body bundle is created, but in that the torsion can also ensure a continuous, well controllable removal of the molded bodies from the spinnerets, which can reliably prevent the molded bodies from accumulating and the spinning curtain from bloating. Thus, it is possible to provide a particularly simple and reliable process sequence for spinning up a spinning device. As a further consequence, this also advantageously results in a steadier and more stable spinning process.

The invention also proves particularly advantageous if the spinning method is a lyocell process and if the molded bodies are cellulosic molded bodies, more particularly, cellulosic fibers, extruded through spinnerets of the spinning device from a spinning solution containing water, cellulose, and tertiary amine oxide. After all, in such a method, twisting of the spinning curtain can already take place in the air gap between spinnerets and spinning bath, whereby better accessibility and thus a considerably simpler method are created.

Generally, it is noted that the term molded bodies can refer to continuous fibers and filaments as well as to sheets and sleeves. Such molded bodies can, for example, subsequently be processed into staple fibers, nonwoven fabrics, yarns, textiles, or three-dimensional objects such as microspheres.

Twisting the spinning curtain into the molded body bundle is very easy to do if the torsion axis is substantially parallel to the extrusion direction of the extruded molded bodies. Furthermore, if the torsion axis passes through the center of the spinning curtain, then it can be ensured that the torsion of the spinning curtain acts evenly and symmetrically on all molded bodies. Thus, in the course of spinning up, it is possible to create a particularly homogeneous molded body bundle devoid of internal stresses, which can further decrease the susceptibility to spin-up defects. This makes it possible to provide a particularly reliable and reproducible spin-up method.

If the molded bodies of the spinning curtain are deposited with their ends onto a rotatable torsion means of a rotation device, which torsion means causes the torsion of the spinning curtain through its rotation, a particularly reproducible and even torsion of the spinning curtain can be ensured. More particularly, the velocity of the torsion of the spinning curtain can be adapted and attuned to the required parameters of the spinning device via the rotational velocity of the torsion means, whereby particularly stable spinning conditions during spin-up can be ensured. Thus, the desired draw-off velocity of the molded bodies from the spinnerets and thus the desired molded body characteristics (such as the thickness of the molded body bundle, etc.), for example, can be adjusted by means of the rotational velocity of the rotation device, whereby the formation of spinning defects can be reliably prevented. The reproducibility of the spin-up method can thus be increased further. Furthermore, the use of a rotation device for the torsion of the spinning curtain can contribute to reducing the physical effort required from the operator of the spinning device, which further simplifies carrying out the method.

If the rotation device is positioned underneath the spinning curtain so that the ends of the molded bodies, following their extrusion, come to rest on the non-moving torsion means, then the effort required from the operators of the spinning device can be reduced considerably, especially in the initial phase of the spin-up process. This applies particularly if, after depositing the ends of the molded bodies, the torsion means of the rotation device is accelerated in steps in its rotational velocity until reaching a final velocity. It is also conceivable that, after depositing the molded bodies, the rotational velocity is accelerated continuously. Furthermore, it is noted that the acceleration of the torsion means can take place in linear or non-linear acceleration profiles in order to optimize the torsion of the molded bodies in accordance with their characteristics. In the initial phase, handling the newly extruded spinning curtain very swiftly is of great importance, as errors in handling can, in this phase, lead to the increased formation of spinning defects which make a new spin-up procedure necessary. Thus, the method according to the invention can prove advantageous due to a lower susceptibility to spin-up defects and the reduction of the extent of the fine-motor and physical effort required from the operators, as well as due to a high degree of reproducibility.

The above-mentioned advantages are particularly easy to achieve by process technology, if the torsion means is formed as a rotatable turntable and the rotation axis of the turntable extends substantially parallel to the extrusion direction of the molded bodies.

The torsion of the spinning curtain can be designed to be yet more reliable if the ends of the molded bodies adhere to holding elements of the turntable. After all, with the rotation of the turntable, the holding elements can entrain the ends of the molded bodies in their rotating motion and twist the molded bodies around one another, around a common point of contact in the spinning curtain, and thus cause the torsion of the spinning curtain.

If the torsion of the spinning curtain creates an engagement area on the molded body bundle, then the particularly advantageous and simple handling of the molded body bundle can be enabled in the spin-up method. After all, by forming an engagement area on the molded body bundle, it can be manipulated and subjected to further processing easily and reliably in subsequent method steps. Furthermore, the defined engagement area permits the automated, machine-based handling and manipulation of the molded body bundle. Furthermore, if the engagement area is created in the area of the smallest diameter of the twisted molded body bundle, then particularly reliable handling of the molded body bundle can be achieved. As a result of the torsion of the spinning curtain into a molded body bundle, the area of the smallest diameter of the molded body bundle is located substantially at the vertex of the spinning curtain, which enables the easy, particularly machine-based, recognition of the engagement area, for example, for the fully automatic manipulation of the molded body bundle.

Furthermore, if an engagement area on the molded body bundle having a diameter from 1 to 20 cm, more particularly from 3 to 12 cm, is created, then the reproducibility of the spin-up method can be increased further. After all, such a molded body bundle can prove advantageous due to particularly reliable handling conditions, more particularly reliable machine-grippability, in further method steps.

A particularly simple spin-up method can be created if an automatic gripping device grabs the molded body bundle and feeds it to the draw-off member of the spinning device. In this case, an automatic gripping device can, for example, be a gripper on a manipulator arm, which automatically grabs the molded body bundle after having been twisted, transports it to the draw-off member by displacing the manipulator arm, and provides it in the draw-off member (for example, by chucking, clamping, fastening, etc.). In doing so, the gripping device advantageously grabs the molded body bundle at the formed engagement area and is therefore able to guarantee a high level of process reliability. In this method it can also prove particularly advantageous if the molded body bundle is not provided in the draw-off member until the rotation device has reached a final velocity. After all, this permits that the molded body bundle is formed completely and exhibits the necessary characteristics for further processing, on the one hand, and that the desired characteristics of the extruded molded bodies (for example, the desired fiber titer) are achieved, on the other. In this case, the final velocity of the rotation device can be determined by the desired molded body characteristics and by the required draw-off velocity of the molded bodies from the spinnerets, respectively. In this case, the manipulator arm that provides the molded body bundle in the draw-off member should advantageously be attuned, in terms of both moving velocity and motion profile, to the extrusion of the molded bodies, particularly to the draw-off velocity of the molded bodies. Excessively fast movements or unfavorable draw-off angles in the motion path can in turn lead to spin-up defects, more particularly to causing that molded bodies in the spinning curtain rupture, which requires that the spin-up process needs to be carried out again. By using the spin-up method according to the invention, the above-mentioned spin-up defects can be avoided, and, accordingly, a spin-up method having a high degree of reproducibility can be created which can also be operated fully automatically and can provide for a significant reduction of the effort required in the course of the process from the operator of the spinning system as compared to known methods.

Furthermore, the spin-up method can be designed as being more reliable if the molded fiber bundle, after having been grabbed by the automatic gripping device, is cut off. Advantageously, the fiber body bundle is, in this case, cut off underneath the engagement area so that the lower part of the molded body bundle that is deposited at the rotation device is severed. Thus, feeding the cut molded body bundle to the draw-off member can be facilitated significantly.

Furthermore, the invention relates to a spin-up device for spinning up a spinning device, including a bundling device for bundling of molded bodies extruded from the spinnerets of the spinning device, which bundling device includes a rotation device with at least one means that is rotatable around a rotation axis, the rotatable means being configured such that the molded bodies are combined into the molded body bundle with the help of said means.

Therefore, it is another object of the invention to improve a spin-up device of the aforementioned type such that the method for spinning up the spinning device—particularly bundling of the spinning curtain into a molded body bundle—can be performed easily and reproducibly and with little physical effort by using the spin-up device.

The invention solves the object regarding the spin-up device in that the rotatable means is formed as a torsion means, more particularly as a turntable, for the torsion of the molded bodies, and the rotation axis of the torsion means is substantially parallel to the extrusion direction of the molded bodies.

If the spin-up device includes a bundling device for bundling the extruded molded bodies into a molded body bundle, and if the rotatable means is configured as a torsion means for the torsion of the molded bodies, and if the rotation axis of the torsion means is substantially parallel to the extrusion direction of the molded bodies, then a particularly stable and simple spin-up device for a spinning device can be created that will particularly permit the further simplification of a method for spinning up the spinning device. In this case, the rotation device with the torsion means can, more particularly, be configured for receiving ends of the extruded molded bodies from the loose spinning curtain so that the ends of the molded bodies can be deposited on the torsion means and a torsion of the spinning curtain can be generated by the rotating motion of the torsion means. The rotating motion of the torsion means and the associated torsion of the spinning curtain into a molded body bundle can thus replace the difficult step of bundling the molded bodies with a structurally very simple device.

If the torsion means is formed as a turntable, then the torsion of the extruded molded bodies can be achieved in a structurally very simple manner. This is particularly the case if the turntable is configured such that it can be rotated substantially parallel to the extrusion direction of the molded bodies extruded from the spinnerets. After all, in this case, a rotation device for the torsion of the loose spinning curtain consisting of extruded molded bodies around a torsion axis in parallel to the extrusion direction of the molded bodies can be created which is capable of producing a compact molded body bundle in a particularly stable and reliable manner. Thus, the overall reliability and stability of the spinning device can be increased further. This is particularly the case if the torsion means is configured for twisting the extruded molded bodies around a common torsion axis and if the torsion axis of the molded bodies coincides with the rotation axis of the torsion means.

Generally, it is also mentioned that the spin-up device according to the invention is particularly preferred as suited for spinning up a spinning device for the extrusion of cellulosic molded bodies from a spinning solution containing water, cellulose, and tertiary amine oxide.

The reliability of the spin-up device can be increased further if the torsion means includes holding elements to increase the adhesion between the molded bodies and the torsion means. This is particularly the case if the holding elements are formed as hooks.

Furthermore, if the spin-up device includes at least one manipulator arm and at least one end effector on each manipulator arm, at least one end effector forming the bundling device, then a stable spinning device can be created which permits simple and reproducible spinning up. In this case, the spin-up device can, more particularly, perform spinning up of the spinning device in a fully automatic manner so as to reduce the physical and motor effort required from the operators of the spinning device. While the known spinning devices mentioned at the outset require a tremendous physical effort in order to provide the molded body bundle extruded from the spinnerets in a draw-off member of the spinning device, the physical effort required in the spinning device according to the invention is comparatively low, thus easing the burden on the operators significantly. Furthermore, the spinning device according to the invention can prove advantageous due to a great ease of handling and high operating safety.

The handling of the spinning device can be simplified further if the spin-up device includes a first manipulator arm with a first end effector, the first end effector including a gripper for grabbing a molded body bundle. In this case, the gripper on the first manipulator arm can be configured such that it is able to reliably grab the molded body bundle and feed it to a draw-off member of the spinning device. The transport of the molded body bundle from the spinnerets to the draw-off member can be performed by displacing the first manipulator arm, more particularly along freely selectable trajectories in space. In this case, in a spin-up method for the spinning device, the comparatively physically strenuous and difficult-to-reproduce steps of manually inserting the molded body bundle can be dispensed with. Not only does this represent a significant reduction of the physical effort required from the operators of the spinning device, but it can also contribute greatly toward enhancing safety against errors in operating the spinning device.

Furthermore, if the spin-up device includes a second manipulator arm with a second end effector, the second end effector including the bundling device, then a particularly flexible spin-up device with a bundling device can be created, which bundling device is thus designed as displaceable between a use position and a rest position as needed. Accordingly, the spin-up device can react flexibly to the requirements of the method: for example, the bundling device can, when not in use, be displaced into a rest position, thus avoiding undesired interference by the bundling device in the spinning device. Thus, the rotation device can be retracted and advanced between the spinnerets and the spinning bath container, depending on the stage of the process. This way, a more reliable spinning device can be created. Furthermore, a structurally simple bundling device can be created if it is formed by the rotation device.

The handling of the molded body bundle by the spin-up device can be improved further if the spin-up device also includes a cutting device for cutting off the molded body bundle. Preferably, the cutting device can be provided on the first manipulator arm and, more preferably, be operatively connected to the gripper such that cutting off the molded body bundle after a successful grab procedure by the gripper will be carried out automatically.

Another object of the invention is to make a spinning device of the type mentioned at the outset more reliable and to facilitate spinning up of the spinning device.

The invention solves this object by providing a spinning device for the continuous extrusion of molded bodies, more particularly for the extrusion of cellulosic molded bodies from a spinning solution containing water, cellulose, and tertiary amine oxide, including at least one spinning bath container containing spinning bath, spinnerets associated with the spinning bath container for the extrusion of the molded bodies from the spinnerets into the spinning bath, with a spin-up device for spinning up the spinning device according to any of claims 9 to 14.

According to the invention, a rotation device with a rotatable torsion means can also prove advantageous when used to bundle molded bodies extruded from the spinnerets of a spinning device by twisting these molded bodies into a molded body bundle by means of the torsion means. In this case, the torsion means can, for example, be a turntable. Furthermore, in this case, it is particularly advantageous if the rotation axis of the torsion means is substantially parallel to the extrusion direction of the extruded molded bodies and if the torsion means is, independently of the spinning device, designed as freely rotatable with respect thereto. More particularly, the above-mentioned rotation device can prove advantageous when being used for the execution of the inventive spin-up method according to claims 1 to 8.

SHORT DESCRIPTION OF THE DRAWINGS

Hereinafter, the subject-matter of the invention is illustrated by way of example with reference to an embodiment, wherein.

DETAILED DESCRIPTION OF THE INVENTION

Figure 1:
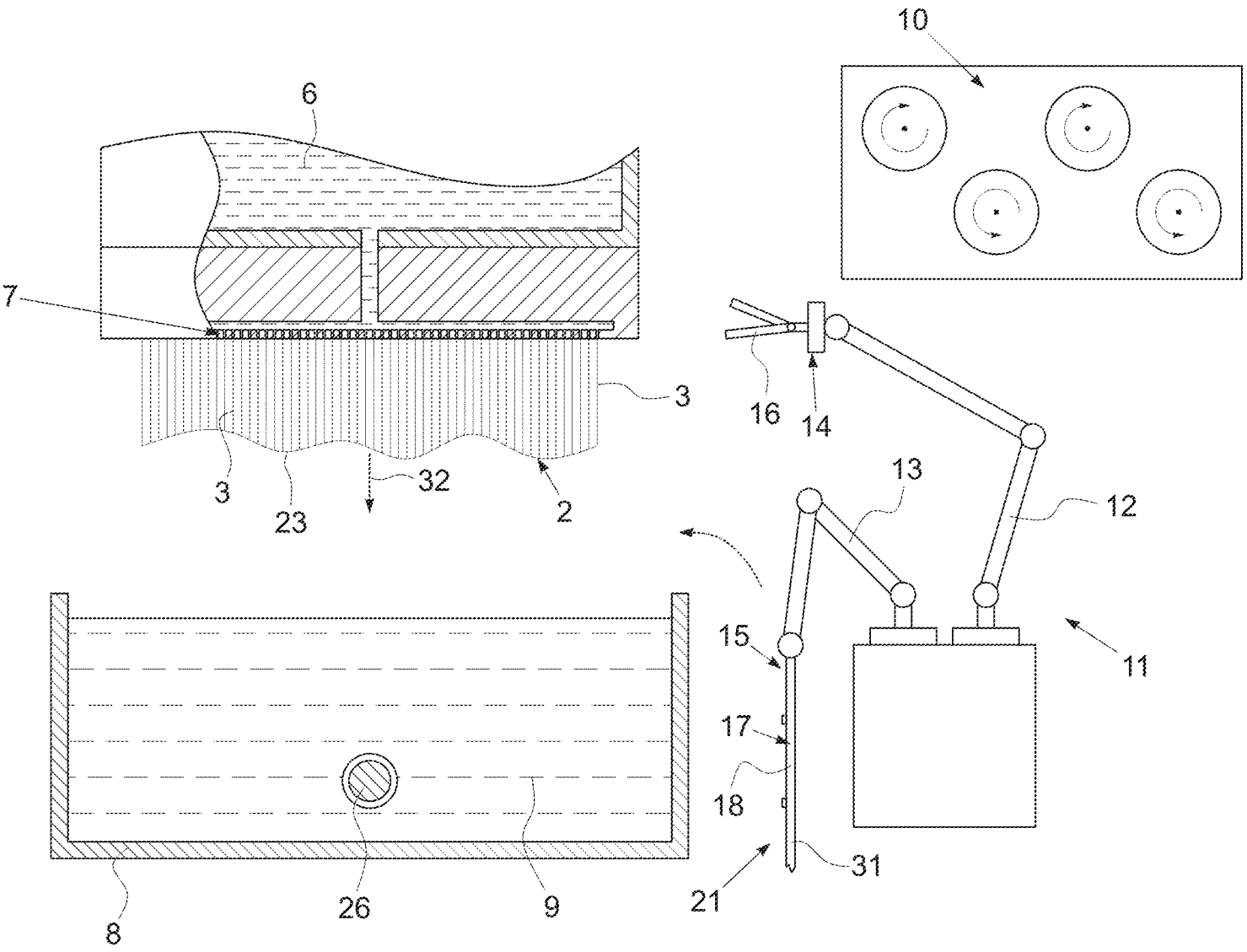
FIG. 1 shows a partially broken side view of the spinning device according to the invention prior to the execution of the method according to the invention for spinning up the spinning device.
Figure 2:
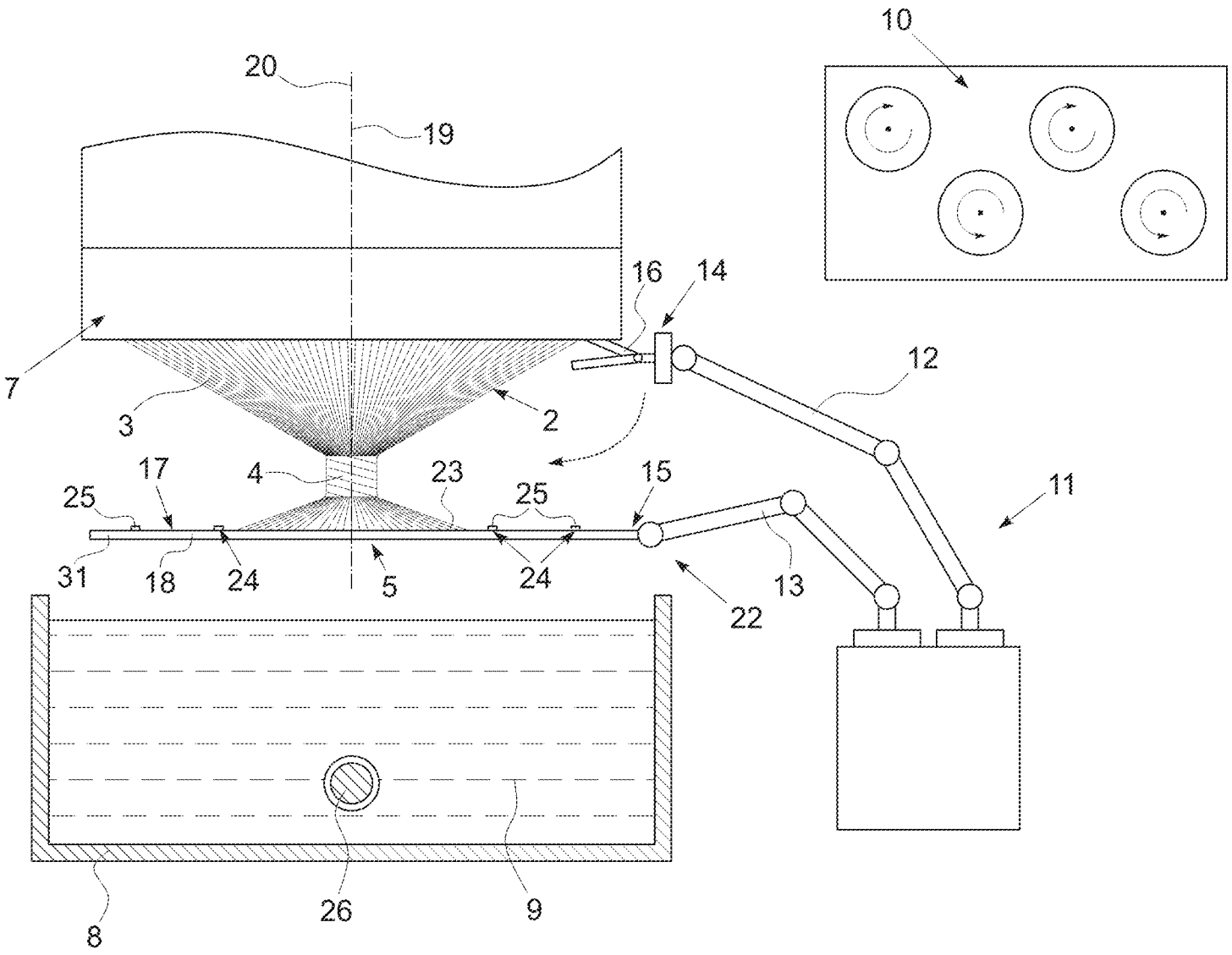
FIG. 2 shows a schematic view of the method according to the invention for spinning up the spinning device during a first method step.

Referring to FIGS. 1 to 4, a spinning device 1 in various stages of the spin-up process is shown. FIG. 1 shows the spinning device 1 with the loose spinning curtain 2 of extruded molded bodies 3 prior to spin-up, i.e., before the molded bodies 3 are combined into a molded body bundle 4 in a bundling device 5 as shown in FIG. 2. Furthermore, the spinning device 1 includes a spinning solution 6 that is extruded through a plurality of spinnerets 7 to form the molded bodies 3. In this case, the spinning solution 6 is preferably a solution containing water, cellulose, and a tertiary amine oxide. Underneath the spinnerets 7, a spinning bath container 8 is provided that contains a spinning bath 9. Preferably, a mixture of water and a tertiary amine oxide is used as the spinning bath 9.

Figure 4:
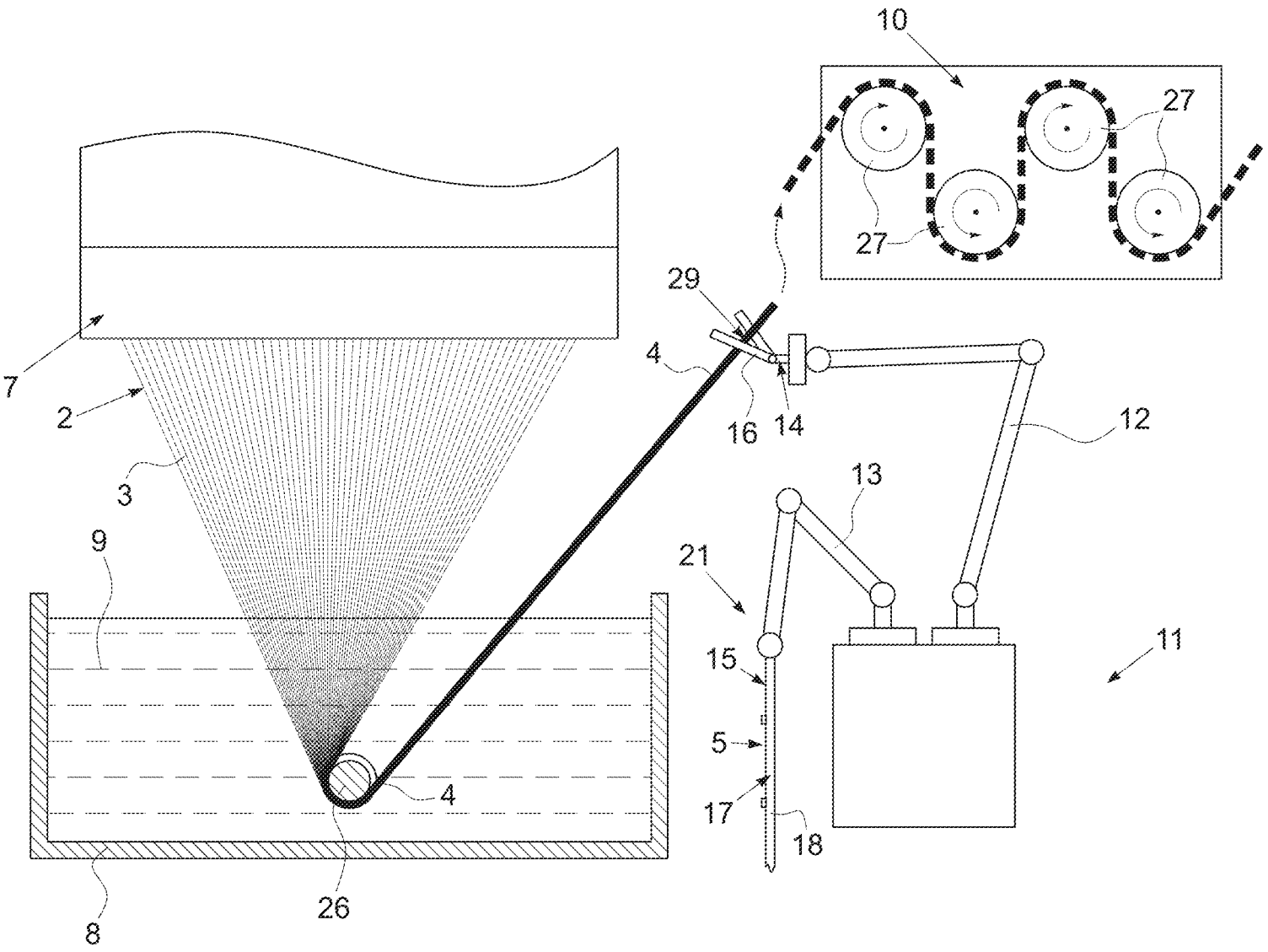
FIG. 4 shows a partially broken side view of the spinning device according to the invention after completion of the spin-up method.

FIG. 4, for its part, shows the spinning device 1 after spin-up. Accordingly, the molded bodies 3 have been combined into a molded body bundle 4 by the bundling device 5, and the molded body bundle 4 is being transported continuously by a draw-off member 10 of the spinning device 1, whereby a continuous extrusion of molded bodies 3 from the spinnerets 7 is taking place.

As can also be seen in FIG. 1, the spinning device 1 includes a spin-up device 11 for executing the method for spinning up the spinning device 1, the spin-up device 11 including a bundling device 5, a first manipulator arm 12, and a second manipulator arm 13. On the first manipulator arm 12, a first end effector 14 is provided, which end effector 14 is formed as a gripper 16. In this case, the gripper 16 is configured such that it can force-fittingly enclose and grab the molded body bundle 4. Furthermore, the gripper 16 is movably and controllably connected to the first manipulator arm 12. In connection with the free movability of the manipulator arm 12, the gripper 16 can move the grabbed molded body bundle 4 along nearly any given trajectory.

Furthermore, the spin-up device 11 includes a rotation device 17 that causes the torsion of the molded bodies 3 in the loose molded body curtain 2. To this end, the rotation device 17 includes a rotatable torsion means 18 that is preferably formed as a turntable 31, the torsion means 18 and the turntable 31, respectively, being provided as an end effector 15 on the second manipulator arm 13 and performing the function of the bundling device 5. The rotation axis 19 of the torsion means 18 and thus the torsion axis 20 of the spinning curtain 2 is, more particularly, arranged in parallel to the extrusion direction 32 of the molded bodies 3 in the loose spinning curtain 2.

Figure 5:
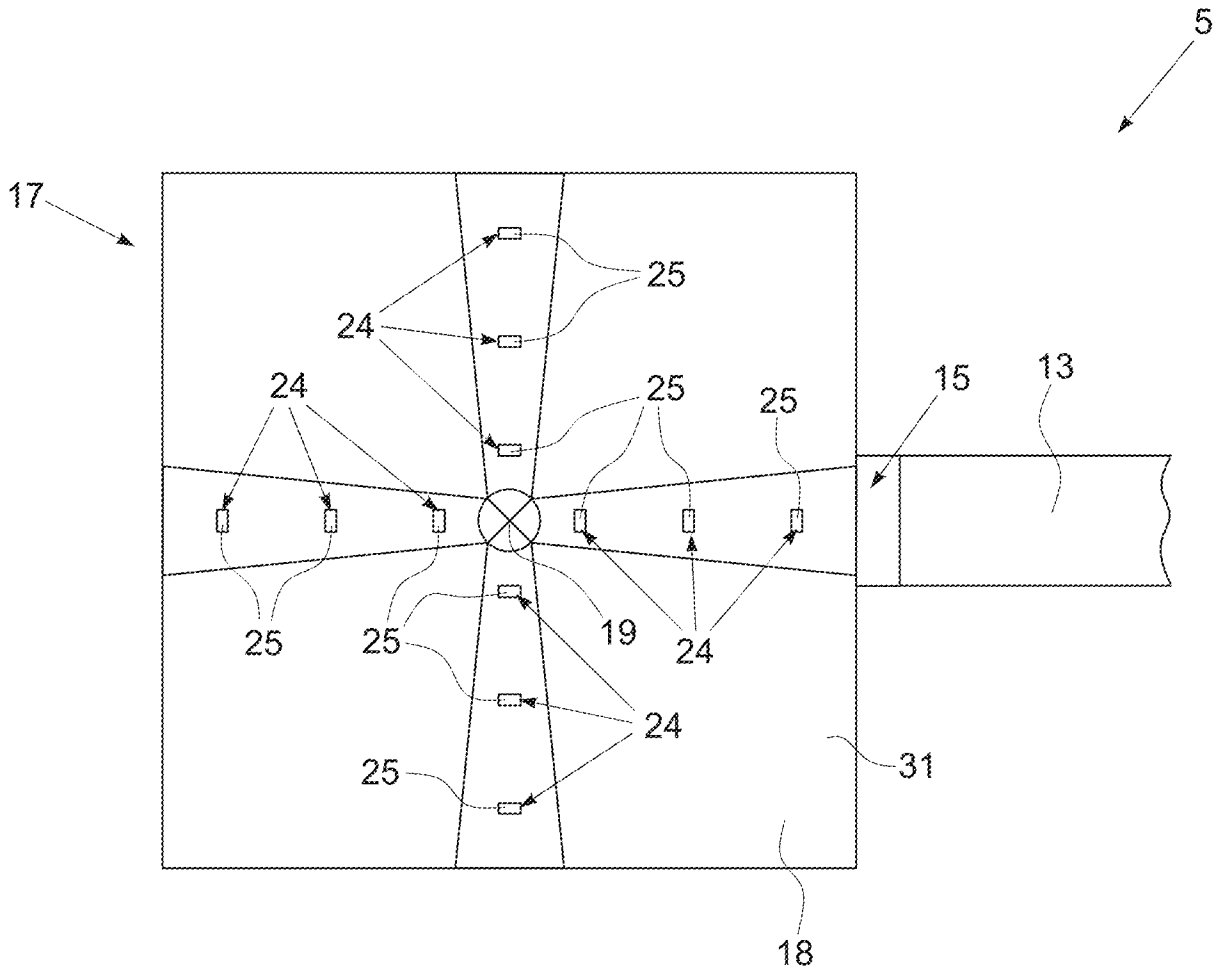
FIG. 5 shows a partial plan view of a rotation device of the spinning device according to the invention.

FIG. 5 shows a detailed plan view of the rotation device 17 of the spin-up device 11. In order to guarantee a reliable torsion of the spinning curtain 2, holding elements 24 in the form of hooks 25 are provided on the torsion means 18 and particularly on the turntable 31, respectively. As a result, the molded body ends 23 can reliably adhere to the hooks 25 and impart torsion to the spinning curtain 2 via the rotating motion of the torsion means 18.

The torsion means 18 serving as a bundling device 5 can be advanced and retracted between the spinnerets 7 and the spinning bath container 8 by means of the second manipulator arm 13, whereby the bundling device 5 can be displaced from a rest position 21 to a use position 22 as needed. Thus, the bundling device 5 can remain in the rest position 21 during the continuous extrusion of the molded bodies 3 and will not constitute an obstacle between the spinnerets 7 and the spinning bath container 8. If renewed spinning up of the spinning device 1 becomes necessary, then the bundling device 5 can be displaced to the use position 22 and permit the execution of a spin-up method according to the invention.

The inventive method for spinning up the spinning device 1 is shown schematically in FIGS. 1 to 4. FIG. 1 shows the spinning device 1 in the first step of the spin-up method. The molded bodies 3 are extruded from the spinnerets 7 in the form of a loose spinning curtain 2. In a further step—as shown schematically in FIG. 2—the bundling device 5, more particularly the torsion means 18 and the turntable 31, respectively, is positioned between the spinnerets 7 and the spinning bath container 8 such that the ends 23 of the extruded molded bodies 3 come to rest on the torsion means 18. The molded body ends 23 adhere to the holding elements 24 and hooks 25, respectively, of the torsion means 18 formed as a turntable 31, thus increasing the adhesion between the molded bodies 3 and the torsion means 18 so that undesired gliding of the molded bodies 3 on the torsion means 18 is prevented. Preferably, the torsion means 18 is at standstill at the beginning of the method, however, it can also be put into rotation before the molded body ends 23 impinge on the torsion means 18. After the molded body ends 23 have impinged on the torsion means 18, the rotational velocity of the torsion means 18 will be increased until a predetermined final velocity is reached. This can, for example, be done in steps or continuously according to a predefined acceleration profile. The rotation of the torsion means 18 causes the spinning curtain 2 to be twisted around the torsion axis which is preferably located parallel to the extrusion direction 32 of the molded bodies 3 and passes through the center of the spinning curtain 2. The final velocity of the torsion means 18 of the rotation device 17 determines the desired draw-off velocity of the molded bodies 3 from the spinnerets 7 for the spin-up procedure and thus, for example, the desired fiber titer during spin-up. Furthermore, the diameter 28 of the molded body bundle 4 can be influenced via the rotational velocity. In this method, diameters 28 from 1 to 20 cm, more preferably from 3 to 12 cm, have proven particularly preferable, as such diameters 28 permit the simple and reliable handling of the molded body bundle 4 with a gripper 16. The torsion of the spinning curtain 2 creates an engagement area 29 on the molded body bundle 4, which is preferably located in the area of the smallest diameter 28 of the molded body bundle 4. Furthermore, the torsion of the spinning curtain 2 also leads to the formation of a vertex 30 on the twisted spinning curtain 2, the smallest diameter 28 of the molded body bundle 4 substantially being at the vertex 30.

FIG. 2 shows the spinning device 1 according to FIG. 1 after the torsion means 18 has been displaced from its rest position 21 to its use position 22 by means of the second manipulator arm 13 and positioned between the spinnerets 7 and the spinning bath container 8. Then, in a second method step, the spinning curtain 2 was produced as described hereinabove by means of the rotation of the torsion means 18, and thus the molded body bundle 4 was created.

Figure 3:
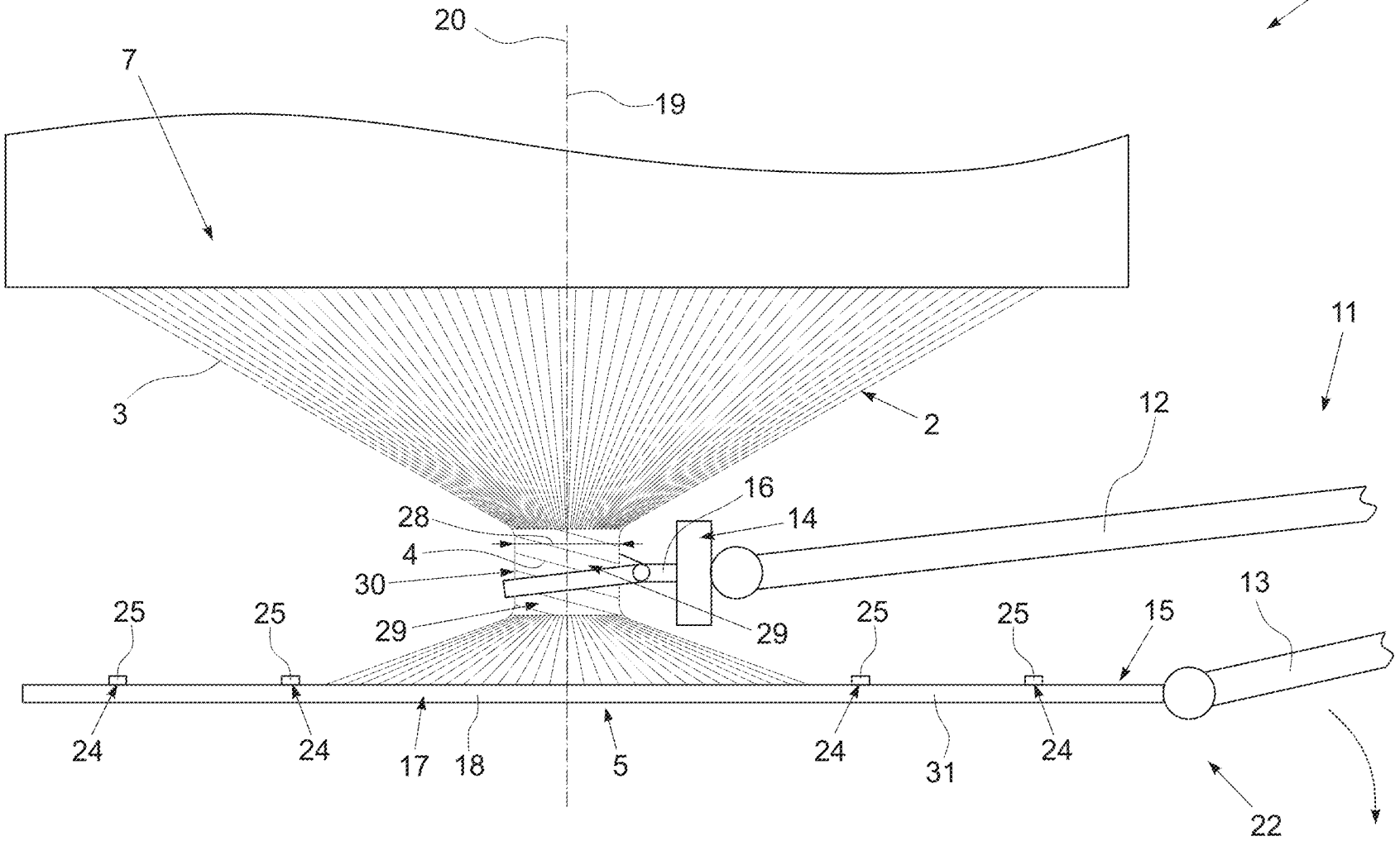
FIG. 3 shows a schematic view of the method according to the invention during a further method step.

Furthermore, FIG. 3 shows the spinning device 1 after the molded body bundle 4 has been created through torsion of the spinning curtain 2. The molded body bundle 4 is now grabbed by the gripper 16 on the first manipulator arm 12 of the spin-up device 11 in order to subsequently provide the molded body bundle 4 to a draw-off member 10 of the spinning device 1.

In this case, FIG. 4 shows the last method step, wherein the molded body bundle 4 held reliably by the gripper 16 is first transported through the spinning bath 9 around a deflection member 26 in the spinning bath container 8 by means of the first manipulator arm 12. Subsequently, the molded body bundle 4 is moved out of the spinning bath container 8 again and inserted into the draw-off member 10 which more particularly consists of a row of juxtaposed draw-off godets 27. Following the insertion of the molded body bundle 4 into the draw-off member 10, a continuous extrusion of the molded bodies 3 from the spinnerets 7 is possible, and the spin-up process has thus been completed successfully.

What is claimed is:

1. A spin-up device for spinning-up a spinning device, which comprises a bundling device for bundling of molded bodies from a loose spinning curtain extruded from spinnerets of a spinning device into a molded body bundle, which bundling device includes a rotation device configured to be used during spin-up, wherein the rotation device comprises at least one turntable that is rotatable around a rotation axis, the turntable being configured such that the molded bodies are combined into the molded body bundle with the help of said turntable, wherein the turntable is for the torsion of the molded bodies, and that the rotation axis of the turntable is substantially parallel to the extrusion direction of the molded bodies, wherein the rotation device is configured to receive ends of the molded bodies from the loose spinning curtain so that the ends of the molded bodies are deposited on the turntable and the turntable is configured to generate a torsion of the loose spinning curtain.

2. The spin-up device according to claim 1, wherein the turntable is configured for twisting the extruded molded bodies around a common torsion axis and that the torsion axis of the molded bodies coincides with the rotation axis of the turntable.

3. The spin-up device-according to claim 1, wherein the turntable includes holding elements to increase the adhesion between the molded bodies and the turntable.

4. The spin-up device according to claim 1, wherein the spin-up device includes a first manipulator arm with a first end effector, the first end effector including a gripper for grabbing a molded body bundle.

5. The spin-up device according to claim 1, wherein the spin-up device includes a second manipulator arm with a second end effector, the second end effector including the bundling device.

6. The spin-up device according to claim 1 or 5, wherein the bundling device is configured as displaceable between a rest position and a use position.

7. A spinning device for the continuous extrusion of molded bodies from a spinning solution, comprising at least a spinning bath container containing spinning bath, spinnerets associated with the spinning bath container for the extrusion of the molded bodies from the spinnerets into the spinning bath, with a spin-up device for spinning up the spinning device according to claim 1.

8. The spin-up device according to claim 3, wherein the holding elements are hooks.

9. The spin-up device according to claim 6, wherein the bundling device is configured as displaceable between a rest position and a use position by means of the second manipulator arm.

10. The spinning device according to claim 7, wherein the molded bodies are cellulosic molded bodies extruded from a spinning solution comprising water, cellulose, and tertiary amine oxide.

11. Use of a spin-up device for spinning-up a spinning device, wherein the spin-up device comprises a rotation device configured to be used during spin-up, wherein the rotation device comprises a turntable that is rotatable with respect to the spinning device, for bundling of molded bodies from a loose spinning curtain extruded from spinnerets of the spinning device into a molded body bundle by twisting the molded bodies by the turntable, wherein the rotation device is configured to receive ends of the molded bodies from the loose spinning curtain so that the ends of the molded bodies are deposited on the turntable and a torsion of the loose spinning curtain is generated by rotating motion of the turntable.

* * * * *